United States Patent [19]

Abrams et al.

[11] Patent Number: 4,616,574

[45] Date of Patent: Oct. 14, 1986

[54] PROCESS FOR TREATING COMBUSTION SYSTEMS WITH PRESSURE-HYDRATED DOLOMITIC LIME

[75] Inventors: Jack Z. Abrams; Robert M. Sherwin, both of San Rafael, Calif.

[73] Assignee: Empire State Electric Energy Research Corp. (ESEERCO), New York, N.Y.

[21] Appl. No.: 614,049

[22] Filed: May 25, 1984

[51] Int. Cl.[4] ..... B01D 53/34; C10L 10/04; C10L 10/06

[52] U.S. Cl. ..... 110/343; 44/1 SR; 110/345; 423/242; 423/244

[58] Field of Search ..... 44/1, DIG. 3; 110/343, 110/345; 423/242, 244, 512, 554, 555

[56] References Cited

U.S. PATENT DOCUMENTS 3,002,855 10/1961 Phillips et al. .
3,249,075 5/1966 Nelson et al. .
3,919,394 11/1975 Selmeczi .
3,951,646 4/1976 Hamada et al. ..... 423/244 A
4,185,080 1/1980 Rechmeier .
4,246,245 1/1981 Abrams et al. ..... 423/242
4,280,817 7/1981 Chauhan et al. .

OTHER PUBLICATIONS

Hansen et al., "Fuel Ash Corrosion and its Effects on Boiler Design," Transactions of ASME, Apr. 1965, pp. 210-214.

Contieri et al., "Slurry Spraying for the Control of Corrosion and Deposits in Oil-Fired Boilers," ASME, paper No. 60-W-284.

Goodrich, "Refuse Disposal and Power Production," Archibald Constable & Co., 1904 Preface.

*Primary Examiner*—John Doll
*Assistant Examiner*—Jeffrey Edwin Russel
*Attorney, Agent, or Firm*—Sandler & Greenblum

[57] ABSTRACT

A process for eliminating, reducing or modifying slagging, convective tube fouling, corrosion, sulfur trioxide formation, acid smut and plume visibility by intermittently injecting pressure-hydrated dolomitic lime consisting of porous, particles having a high specific surface and a low settling rate in water into the interior of a combustion system.

19 Claims, 3 Drawing Figures

PROCESS FOR TREATING COMBUSTION SYSTEMS WITH PRESSURE-HYDRATED DOLOMITIC LIME

BACKGROUND OF INVENTION

1. Technical Field

The invention relates to a process for improving furnace operation, and in particular, for reducing, eliminating or modifying: slagging, convective tube fouling, fireside corrosion, fly ash, sulphur trioxide formation, acid smut, and plume visibility problems.

2. Discussion of Prior Art

The recent widespread shutdown of nuclear power generators and the continued instability in both the supply and price of natural gas places an additional burden on coal and oil burning power plants to provide dependable low to medium cost power. This shift has added impetus to research directed towards improving power plant cost effectiveness, environmental cleanliness and fuel efficiency.

One aspect of research has focused on controlling fireside combustion by-products, as they have a tremendous effect on the efficiency and cleanliness of boilers as well as the costs of fuel that they can burn.

Convective tube fouling which results from liquid or sticky phase ash deposition on the tubes, can affect power plant efficiency and cleanliness. Ash deposition is attributed to the fact that the low melting point of coal and oil ash (between 1,000° and 1,200° F.) is often the operating temperature of power plant superheater and reheater tubes. As a result, the ash enters a liquid or sticky phase forming deposits along the nearest surfaces which become harder as the boiler continues to operate. These deposits "foul" areas of the boiler, particularly the superheater tubes, and reduce plant cost effectiveness by reducing the thermal exchange between the superheater tubes and the steam passages. This results in frequent boiler down times for cleaning. This problem has restricted plants to burning higher priced fuel that tend to be low in sodium, sulphur and vanadates. It would be desirable, therefore, to be able to eliminate the liquid or sticky phase which occurs during fly ash deposition.

Fly ash, produced in the furnace during combustion and transported through the superheater tubes, also contributes to the corrosion of tube surfaces as a result of the formation of molten ash deposits. In a paper entitled "Fuel Ash Corrosion and its Effect on Boiler Design", by Hansen et al., *Transactions of ASME*; April 1965, pp. 210–214, industry-reported increases in oil ash and gas-side corrosion were attributed to the increase in gas and/or metal temperatures in new generation boilers; high vanadium content oil; and liquid phase alkali-sulfate compounds which contact the hot metal surfaces. Corrosion is a major deterrent to the effectiveness of newer high temperature boilers as corrosion cannot be prevented merely by the use of high cost, high strength metals. Consequently, avoiding corrosion means reducing fouling deposits and, therefore, controlling the deposition of liquid or sticky phase fly ash.

Slag deposits usually form in the low velocity portions of the boiler passages. The formation of slag results from deposition of heavy waste and combustion by-products in a liquid phase. Control of slagging is a key to enabling the use of refuse-derived and other low cost fuel substitutes as slag formation and the hardness characteristics of slag deposits are a function of the concentration of glass in the fuel. Refuse-derived fuels, for example, are known to contain up to 20% glass. Removal of slag deposits is extremely time-consuming as it requires operation stoppage and steam cleaning and/or air lancing the affected boiler areas. In many cases, slag removal operations can be extremely costly. Heavily slagged checker chambers in open-hearth furnaces, for example, have to be dismantled requiring replacement of as many as 30,000 to 40,000 checker bricks. In this case furnace shutdown time can become severe.

Another long recognized problem in boilers relates to the presence of sulfur trioxide. Sulfur trioxide is formed through conversion in the boiler gas passages of sulfur dioxide to sulfur trioxide with fly ash acting as the catalyst. Sulfur trioxide tends to condense in the cooler sections of the heat exchangers in the form of sulfuric acid. The acid participates in the corrosion of the heat transfer surfaces as well as reducing and limiting the heat economy obtainable. Furthermore, in their paper entitled "Corrosion of Superheaters and Reheaters of Pulverized Coal-Fired Boilers", Melson et al., *Journal of Engineering for Power; Transactions of ASME* 1960 p. 194 strongly link the presence of sulfur trioxide to heavy ash deposits. The authors report that ash deposits have a layered structure, the outermost portion of which comprises a friable fly ash layer which is formed by the mineral portions of the coal and its sulfurous reaction products. The inner layer comprises a harder material containing substantial amounts of sulfur trioxide which, when mixed with the alkaline earth oxides in the fly ash, form complex sulphates. The authors conclude that the complex sulfates are the principal molten compound that bonds the ash deposits to the tube walls and are also the principal components in corroding the tube. Reduction or elimination of sulfur trioxide formation, therefore, is critical to maintaining the boilers in good operating condition. Control of corrosion avoids the necessity of frequent equipment replacement and periodic shutdowns.

Finally, boiler emissions are a major environmental concern, particularly with the respect to less direct and obvious forms of pollution, such as acid rain. Visible emissions have been generally reduced by employing scrubbers and other costly mechanical systems. However, the acid content of these emissions must also be reduced. Therefore, the need to control both the visible plume as well as the acid content of the emissions is critical.

In developing a process for reducing, eliminating or modifying corrosion, fouling, slagging, sulfur trioxide, fly ash, acid smut and plume visibility, an effective, simple and efficient process using comparatively inexpensive materials that can rapidly reduce these problems is highly desirable.

The primary existing method for controlling the above-described fireside related problems has been the addition of chemical additives which raise the melting point of the fly ash, resulting in more friable tube deposits and slag as well as restricted sulfur trioxide formation, reduced corrosion, acid smut and plumes. However, these prior additive addition and treatment techniques have not employed a single additive which, by virtue of an economic injection process, reduces all of the above conditions and requires only minimum quantities of the additive. Further, many prior art additives have created other problems, some of which exceed the problems they solve.

In a paper "Slurry Spraying for the Control of Corrosion and Deposits in Oil Fired Boilers", Cantieri et al., *ASME* paper No. 60-W-284, presented at the 1960 Annual Winter Meeting, New York, the authors review research on additives and their method of injection into oil-fired boilers in order to control a number of fireside-related problems.

Harlow ("Formation of Sulfuric Acid in Boiler Flue Gases", *Transactions of ASME*, 1958 p. 225), for example, describes spraying calcium oxide on the boiler tubes in order to inhibit catalytic oxidation of sulfur dioxide into sulfur trioxide. However, calcium oxide inhibited the reaction for only several hours. The authors also report that Rendle et al., "The Prevention of Acid Condensation in Oil-Fired Boilers", *Journal of the Institute of Fuel*, 1956, pp. 372–380, found that magnesium oxide, zinc dust, dolomite, and gaseous ammonia eliminated the acid dew point, i.e., the point at which sulfur oxide is catalyzed into sulfur trioxide.

With respect to fouling and slagging, Cantieri et al. report that Keck, "Retarding Corrosion and Deposits of the Fire-Side Surfaces of Boilers Fired with Residual Fuel Oils", presented at the Southeastern Electric Exchange, 1959, found that additives of dolomite, high-magnesium lime, magnesium oxide and lime had varying effects on reducing these deposits. Keck also found that the chemicals and, in particular dolomite, slightly reduced the volume of slag. However, the treatment described left tons of additive, vanadium compounds and slag boulders on the furnace floor as a result.

Cantieri et al. then describe a method for slurry spraying the boilers through the soot blowers. The method involves removing loose deposits by first operating the blowers at full pressure. Blowing pressure is then reduced by 50 psi and a slurry consisting of calcium oxide and magnesium oxide particles suspended in an aqueous solution is then introduced along with the blowing medium. Subsequently, the slurry heads are purged with water to properly clean them. The spray system is usually energized once a day. As a result, fouling, corrosion, plume visibility and acid dew point problems are reduced or eliminated. However, the authors report that the degree of improvement appears to be most marked after the additive has been applied and deposit formation continues to occur between the daily injections.

A number of patents also describe processes using additives to control boiler related problems. Chauhan et al., U.S. Pat. No. 4,280,817, is typical of these patents wherein a solid fuel, such as coal, is treated with a catalytic agent so that the coal is physically and chemically altered. The coal is then catalyzed in order that the incorporating catalyst acts as a sulfur absorbent during combustion. The fuel is treated in a liquid medium containing both calcium oxide and magnesium oxide. The slurry is then subjected to elevated temperatures and pressures such that the catalytic agent physically incorporates the water and fuel. The agent comprises either calcium hydroxide, magnesium hydroxide or a possible combination of both. Chauhan et al., however, do not disclose treating the fuel for prevention of corrosion, fouling, slagging, etc. and do not disclose a method that employs small quantities of an additive to alleviate sulfurous emissions.

Other patents which treat one or more boiler problems by adding chemical additives to the boiler include: U.S. Pat. No. 4,185,080, U.S. Pat. No. 3,249,075, U.S. Pat. No. 3,002,855, and U.S. Pat. No. 3,919,394. A large number of additives in these patents and other prior art have been proposed. Based on their chemical constituents and physical characteristics, such additives are:

MgO (oil dispersion)
CaO (dry)
$MgO+Al_2O_3$ (oil dispersion)
$MgO+Mg(OH)_2$ (dry)
Oil-soluble Mg (magnesium naphthenate, etc.)
Oil-soluble MgO+MnO
Mn (Oil Soluble)
$CaCo_3$
MgO+CaO (aqueous dispersion)
Dolomite In summary, therefore, while prior art techniques illustrate a host of additives that are effective in solving a host of specific boiler and fireside related problems, a single additive composition that effectively solves all of the previously described problems has not been found. Additionally, the processes and techniques for introducing these additives into the boiler have not resulted in efficient use of the additives such that material is wasted and additional time is required to reduce these fireside-related problems.

In our previous patent, U.S. Pat. No. 4,246,245, a process for removing sulfur dioxide from boiler effluent gases is described. The process involves contacting the gas in a wet or dry scrubbing zone with recycled tank slurry that contains Type S hydrated dolomitic lime.

However, it was not previously appreciated that the additive composition is highly effective in reducing, eliminating or modifying fouling, slagging, corrosion, sulfur trioxide formation, fly ash, acid smut and visible plumes. In addition, it was not recognized that a more efficient and more effective technique for injecting the additive into the system was available over the continuous method of injection described in U.S. Pat. No. 4,246,245. Finally, it was not appreciated that the injection technique could direct the additive to specific problem sites, rather than generally throughout the boiler interior.

SUMMARY OF THE INVENTION

The present invention, therefore, has particularly as an objective to overcome the problems associated with the inefficient processes disclosed by the prior art by making it possible to reduce, eliminate or modify boiler slagging, convective tube fouling, fireside corrosion, sulfur trioxide formation, fly ash, acid smut and plume visibility problems by employing a process for adding pressure-hydrated dolomitic lime in a highly efficient and effective manner.

A preferred process according to the invention includes treating a combustion system by adding a pressure-hydrated dolomitic lime additive. As a result of the treatment, the environmental quality of emissions and the operational efficiency of the combustion system are improved. The improved injection process involves injecting the pressure-hydrated dolomitic lime in a non-continuous manner during combustion system operation. The injection process thereby minimizes the amount of additive necessary for treating the system.

In another important aspect of this process, a blowing medium is injected into the interior portions of the combustion system in order to loosen and remove deposits. The blowing medium is injected for a pre-determined period of time prior to injecting the pressure-hydrated dolomitic lime additive in order that loose deposits can be removed. The additive is thereby diverted to only those areas that form the strongest bonds with the boiler surfaces. The pressure-hydrated additive is then blown into the interior of the combustion system through the soot blowers. This is accomplished by connecting a mechanical sprayer means to the soot blowers in order that the additive can be injected into the soot blowers which spray the additive onto the deposits. Control of the mechanical sprayer means and the soot blowers is automatic. Injection of the additive can be set to occur at intermittent intervals without the necessity of control by an operator.

In a further aspect of this process, the pressure-hydrated dolomitic lime additive-coated area is then heated and maintained at a temperature of about 1800° F.

According to yet another significant aspect of the process, the pressure-hydrated dolomitic lime additive is injected only into the gas passages of the boiler rather than directly into the furnace area. Fouling deposits and corrosion in the passages are thereby reduced by applying the additive directly to the fly ash. The treated deposits are then removed by blowing them away with soot blowers. Alternately, the pressure-hydrated dolomitic lime additive is injected along with a system fuel directly into the furnace of the combustion system. However, the pressure-hydrated dolomitic lime additive is separated from the fuel in order to avoid bonding between the additive and the fuel.

The pressure-hydrated dolomitic lime additive comprises a powder of finely porous particles having a high specific surface and a low settling rate in water. Particle size is such that substantially 100% of the particles pass through 20 Tyler mesh screen and 79% pass through 325 Tyler mesh screen.

Using the inventive process, the system can burn a combination of refuse-derived fuel along with system fuel. The system fuel can be either coal or oil.

This invention includes limiting the formation of deposits located within a combustion system by selectively injecting a pressure-hydrated dolomitic lime additive during operation of the combustion system directly to the situs of deposition. Moreover, the pressure-hydrated dolomitic lime is selectively injected at a location where the deposit is connected to the interior portion of the boiler.

As opposed to previous techniques, the pressure-hydrated dolomitic lime additive may be injected into the system in amounts less than about 5 lbs/ton of coal. The concentration of the slurry and frequency of the injections are sufficient to raise the melting point of the fly ash and thereby minimize fly ash liquid phase at the situs of injection whereby a weakening point is formed.

The extent of permanent fly ash deposition within the combustion system may be reduced by injecting a slurry of pressure-hydrated dolomitic lime additive particles directly to the situs of fly ash deposition or, more specifically, at the afore-described connection point. The fly ash deposits are subsequently removed by blowing them out of the combustion system. The pressure-hydrated slurry that is used to treat the fly ash preferably has a solids content ranging between about 10–50% by weight.

The invention also relates to a process for reducing slag deposits within a combustion system by injecting a slurry of pressure-hydrated dolomitic lime additive particles directly to the situs of slag deposition or, more specifically, at a point where slag connects to the boiler interior in a concentration and quantity of sufficient to substantially coat the slag deposits. As a result, a narrowing of the temperature range in which the slag is plastic occurs; a reduction of the slag crushing strength of the deposits is achieved; and bonding between the deposits and the interior surfaces of the combustion system is substantially reduced.

The invention further includes a process for reducing the formation of sulfur trioxide by injecting pressure-hydrated dolomitic lime additive directly to the situs of fly ash deposition. As a result, fly ash sintering is reduced by prohibiting the catalyzation of sulfur dioxide emissions by the fly ash into sulfur trioxide.

According to yet another aspect of the invention a process for reducing fire-side corrosion by directing pressure-hydrated dolomitic lime additive to the situs of fly ash deposition to inhibit the formation of complex sulphates on the interior surfaces of the combustion system is provided.

BRIEF DESCRIPTION OF THE DRAWINGS

The annexed drawings show, soley by way of non-limiting example, preferred embodiments of the invention in which.

DESCRIPTION OF PREFERRED EMBODIMENTS

Figure 1:
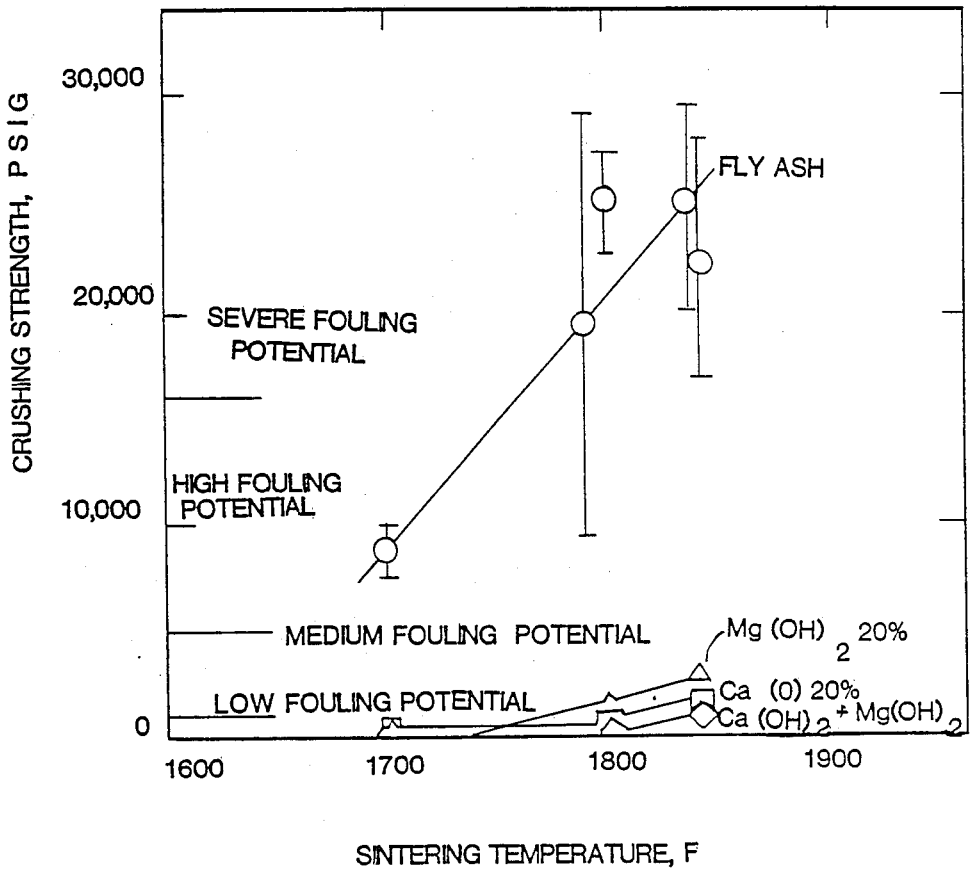
FIG. 1 is a graphical representation of the effect of different additives on the crushing strengths of fly ash samples as a function of temperature.

The use of pressure-hydrated dolomitic lime was first described in our U.S. Pat. No. 4,246,245 for reducing sulfur dioxide emissions by adding the additive to a wet or dry scrubber or a spray dryer such that the neutralizing values of the additive minimize sulfur dioxide emissions when the boiler is operational.

The present process provides a highly efficient injection technique for controlling fireside-related problems by intermittently introducing pressure-hydrated dolomitic lime to the problem areas of the boiler. The additive may be added in either wet or dry forms, and can be introduced into the boiler gas passages or directly into the furnace.

Type S hydrated-dolomitic lime is prepared from calcined dolomite and is available as a structural material from Genstar Building Products. Type S dolomitic lime is hydrated under elevated temperature and pressure. The Genstar Product is approximately 55% calcium hydroxide, 40% magnesium hydroxide, 2% magnesium oxide and 0.02% water. *Chemistry and Technology of Lime and Limestone*, by Boynton, Interscience Publishers, New York, 1965, pp. 167, 288–9, 302–7, 317–8, and 333–338, describes forming Type S dolomitic lime by hydrating the above-described composition in an autoclave at pressures ranging between 25 and 100 psi at temperatures ranging between 250° to 400° F. The resultant product settling rate to one-half volume in minutes (ASTM C-110) is approximately 225 and the specific gravity is 2.24. The hydrated dolomitic lime is composed of particles of which 100% pass through 20 Tyler mesh screen while 79% of the particles pass through 325 Tyler mesh. The composition, therefore, forms a fine powder having particles that are porous and highly dispersable having a high specific surface and a low settling rate in water.

The pressure-hydrated dolomitic lime can be prepared either in powdered form or can be suspended in a liquid base to form a slurry. The amount of solids in the slurry will vary depending upon the particular treatment desired. Further, the concentrations and compositions of the liquid base can vary. Generally, the solids content of the slurry will be at least about 10% by weight and no greater than about 50% by weight of the slurry. Solids content can vary in proportion to the magnitude of the problem to be solved. Heavy slag deposits, for example, could be treated with a high percentage additive weight slurry while liquid phase deposits in the boiler superheater passages, for example, may require a lower solids content slurry to be effective. In addition, the solids content is related to the ash content of coal and varies inversely to the melting point of the ash. Finally, the solids content is limited by the capabilities of the spray system to handle high solids content slurries.

The process for removing, eliminating or modifying fly ash and reducing fouling deposits will be considered first. Fouling deposits can be formed in a few hours or take several weeks. These deposits, if weakly bonded to the interior surfaces of the boiler, can be removed by soot blowing. During removal, the deposits will fracture at the weakest point in the formation. As a result, only one weak region in a given deposit is necessary for conventional soot-blowing removal techniques to be effective. Prior art methods, however, have concentrated on weakening all portions of the deposit by spraying the additive throughout the fouled portions of the boiler. Such a technique typically requires substantial quantities of additive and relatively long blowing periods. The present process, however, reduces fouling and weakens deposits by selectively directing additive only to the situs of deposition or at a location where the deposit is connected to the interior portion of the boiler in an amount and concentration sufficient to cause a weakening point in the deposits. This is accomplished by activating only those soot blowers adjacent to the heavy deposition areas and localizing their spray at the most severe areas of these deposits. As a result, the additive creates a weakened fracture point and subsequent soot blowing will fracture the surrounding deposits at this weakened point. The whole deposit can then be blown out of the system by any known technique.

Further efficiencies are realized by intermittently and locally injecting the additive onto the deposition points. Deposits can form quickly, especially in boilers having superheater passages in the first and second gas passages, and particularly in combustion systems burning low-grade fuels. Frequent intermittent injections of small quantities of additives directly to the situs of deposition results in both a reduction and/or elimination of the deposits, and a reduction in the quantities of additive required to be effective. The frequency and duration of each spraying period are proportionally related. However, the optimal combination of the spraying periods and their frequency of occurrence is unique for each combustion system. Refuse-derived fuel (RDF) burning systems, for example, may have slow forming hard deposits while oil burning systems may have rapidly forming weakly bonded deposits. In the former situation, therefore, less frequent and longer spraying periods may be required to effectively weaken hard deposits while the latter situation may require the reverse. Intermittent local injection, therefore, is an effective additive-efficient method for controlling fouling.

The injection process can most easily be accomplished by employing conventional soot blowers connected to mechanical sprayers adapted to conduct additives into the soot blower. Before introducing the additive, the soot blowers, spray a carrier medium into the boiler interior for a pre-determined period. The mechanical sprayer is then activated and the additive of this invention, pressure-hydrated dolomitic lime, is injected into the soot blowers. The soot blowers accordingly spary the additive and the carrier medium at the deposit points. Once the time period for injecting the additive has elapsed, the spray system is deactivated. The cleaning and blowing process is repeated after a pre-set boiler operating period such that injection of the additives will occur in an intermittent and frequent manner. This injection process thereby prevents significant deposition formation during operation and requires minimal amounts of additive to effectively control deposits.

Factors central to this process such as the concentration of additive relative to presumed deposit size, the heating temperature limit for additive-coated deposits, the length of time required for deposit removal, the quantity of ash in the fuel, the melting point of the ash, and the length of time required for additive injection, are a function of each particular combustion system. In addition, the particular characteristics of each combustion system such as the grade of the system fuel, and the size, location, and composition of the fouling deposits, directly affect the above-noted factors. However, while pilot tests using pressure hydrated dolomitic lime have not been conducted to determine ideal additive concentrations for one or several boiler systems, tests have been conducted that demonstrate the superiority of pressure-hydrated dolomitic lime over other conventional additives in reducing potential fouling deposits. The tests also provide an indication of the relative concentrations of the pressure-hydrated additive needed to effectively treat particular types of deposits at particular temperatures.

Figure 2:
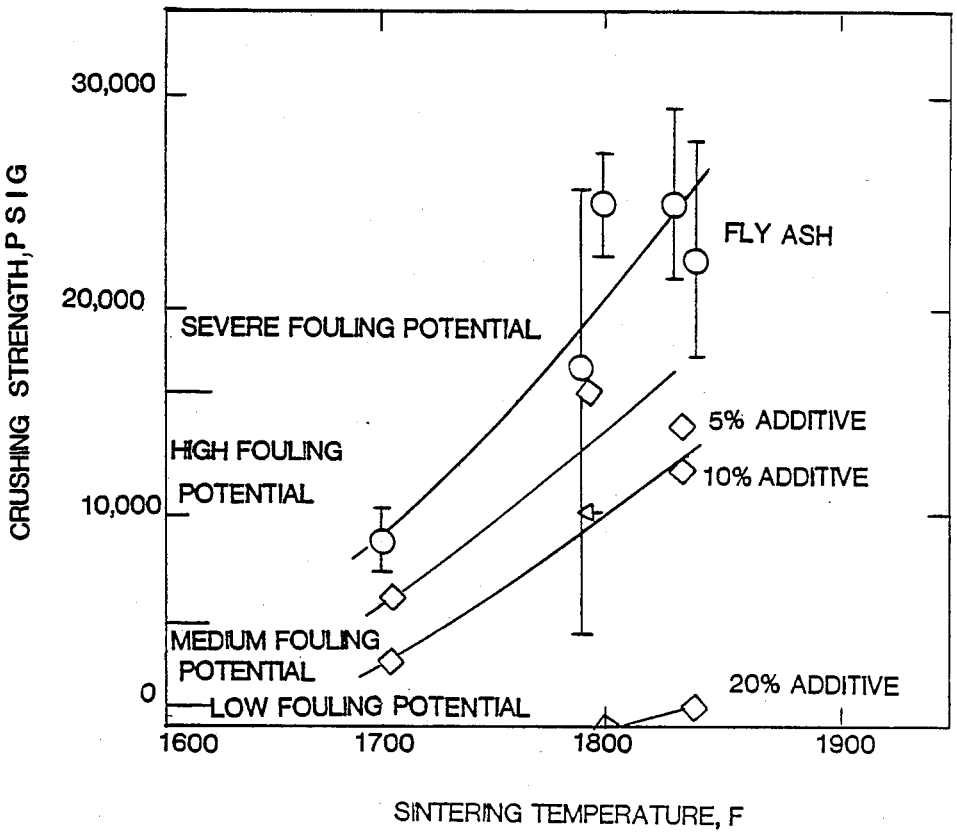
FIG. 2 is a graphical representation of the effect of different concentrations of pressure-hydrated additive on the crushing strengths of fly ash samples, as a function of temperature.
Figure 3:
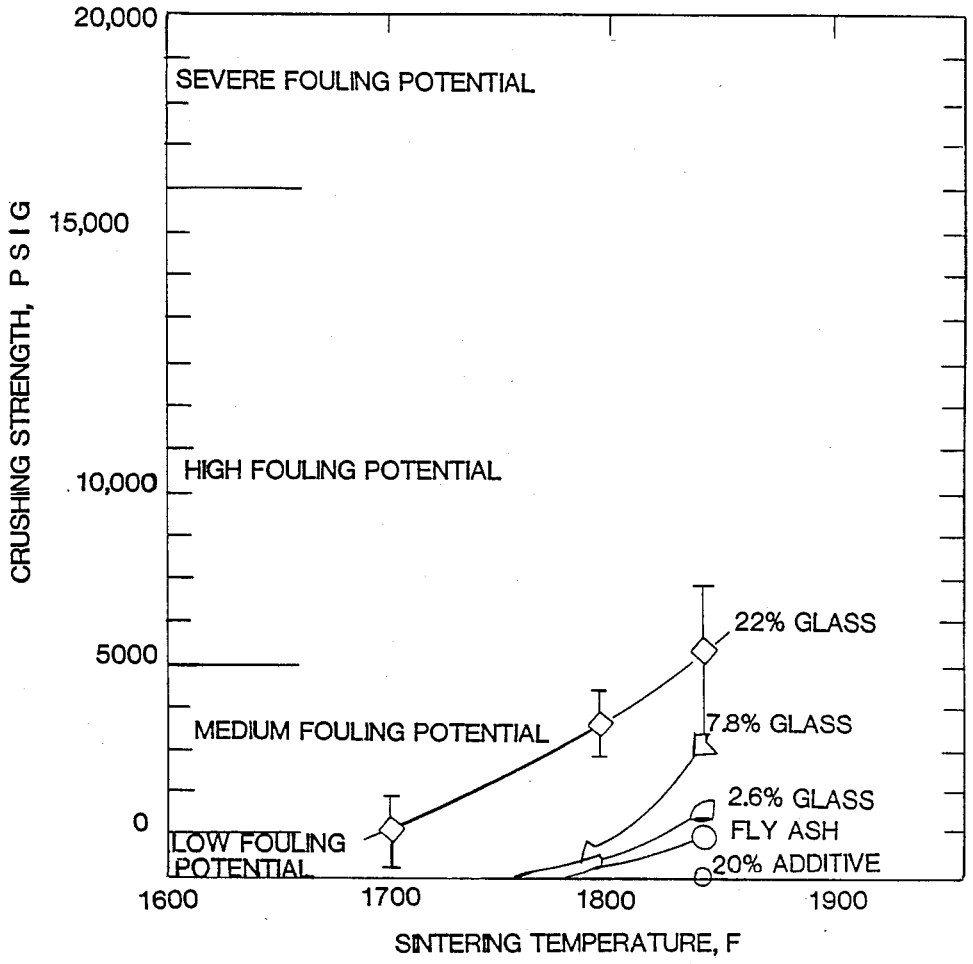
FIG. 3 is a graphical representation of the effect of the pressure-hydrated additive on the crushing strengths of composite glass-fly ash samples as a function of temperature.

The tests, whose results are graphically shown in FIGS. 1-3, were conducted using a procedure that compares ash crushing strengths between various fly ash and additive mixtures. The test were developed by Barnhart et al. and are described in their paper, "Sintering Test, An Index to Ash Fouling Tendency", *Transactions of ASME*, August 1956, pp. 1229–1236. The tests involve taking fly ash samples from the hoppers of several operating utility boilers. The samples are dried and the carbon is removed. The samples and the additives, which include calcium oxide (CaO), magnesium hydroxide ($Mg(OH)_2$), and pressure hydrated dolomitic lime [$Ca(OH)_2+Mg(OH)_2$], are then passed through 100 Tyler mesh screen in order to remove larger particles. Mixtures of the fly ash containing concentrations of the additives are then added to a ball mill according to their weight and formed in a mold into pellets. The pellets are then heated in a laboratory autoclave to sintering temperatures and held at these temperatures for fifteen hours. Once the pellets cool, they are crushed on a specially-designed hand press that records the crushing pressure (psig). Crushing values reported in these tests were an average of the crushing values for six pellets.

The first fly ash samples came from old (units built between 1942 and 1958) down-fired, triple-pass, wet-bottom boilers that burned coal mined from Eastern Kentucky. Temperatures in the fouling superheater passages of these boilers were found to range from 1930° F. to 2760° F. and the fly ash sintering temperatures tended to range between 1700° to 1900° F. To simulate conditions in these boilers, therefore, the pellets are heated to either 1700° F., 1800° F., or 1840° F. A selected pellet is then treated with one of the three aforementioned additives. The quantity of additive added to each fly ash sample is a pre-determined percentage of the total weight of the sample.

FIG. 1 shows the crushing strengths (psig) of the untreated fly ash pellets and fly ash pellets treated with either calcium oxide, magnesium hydroxide or the pressure-hydrated dolomitic lime as a function of temperature. The additive comprises 20% of the total weight for each pellet. As shown, the pressure-hydrated additive reduces the crushing strength of the fly ash from 23,000 psig to less than 1,000 psig at 1840° F. It is known that the crushing strength for low-fouling boiler deposits is less than 1,000 psig. Accordingly, the pressure-hydrated additive-treated pellets are structurally equivalent to a low-fouling deposit and, therefore, have a low-fouling potential. The Ca(O) and $Mg(OH)_2$-treated pellets also show significant crushing strength reductions. Ca(O) reduces pellet crushing strength from about 23,000 psig to about 5,000 psig at 1840° F. $Mg(OH)_2$ reduces the crushing strength to about 2,000 psig. These crushing strengths, however, are designated as medium fouling potential. The pressure-hydrated dolomitic lime additive, therefore, is more effective in reducing potential fouling levels than these more commonly used additives.

FIG. 2 shows the effect of adding smaller amounts of the pressure-hydrated additive to the pellets. As shown, addition of the additive at 5% of the total pellet weight reduces the crushing strength at 1840° F. from a severe fouling potential level to a high potential fouling level. However, at temperatures less than about 1740° F. the crushing strengths are reduced to the medium fouling potential range. A 5% weight concentration of the pressure-hydrated dolomitic lime additive coated on deposits located in low temperature areas of the boiler, therefore, could be effective in weakening deposits.

Similarly, addition of the additive at 10% of the total pellet weight reduced crushing strength from a severe fouling potential level to a high fouling potential level at 1840° F. At temperatures of 1800° F. or less, however, the crushing strengths are reduced to the medium fouling potential range, and at 1700° F. or less the crushing strengths are further reduced to low fouling potential (about 2,000 psig at 1690° F.). Therefore, a 10% additive portion of the total deposit weight will be as effective, in low temperature areas of the boiler, as a 20% additive concentration.

In summary, therefore, the tests not only prove the effectiveness of the pressure-hydrated dolomitic lime over commonly used additives in reducing fly ash fouling potential, but also indicate concentrations in which pressure-hydrated dolomitic lime appear to be the most effective in reducing fouling potential levels. In high-temperature boilers areas concentrations of at least about 20% pressure-hydrated additive of the total deposit weight would be the most effective treatment. Lower concentrations would appear to be more effective for treating fouling deposits in the low temperature areas of the combustion system.

In coal burning systems a 20% weight level can be achieved by adding about five pounds of the pressure-hydrated additive per ton of coal. Although this concentration level cannot be confirmed until pilot tests are run, the results of the crushing strength tests, when applied using conventional knowledge regarding coal fouling, indicate that a 20% weight is achieved with this concentration.

The additive injection process also applies to removing heavy deposits, such as slag, from interior portions of the combustion system. Attempts to utilize refuse-derived fuel (RDF) as an economy fuel have resulted in severe slagging in various areas of combustion systems. Slagging severity is partially dependent on the amount of glass in the deposits. Therefore, the crushing strength tests also treated various fly ash-glass composite pellets with the pressure-hydrated additive in order to determine effectiveness in reducing the fouling potential of these slag equivalent pellets (FIG. 3). As shown in FIG. 3, the fouling potential of fly ash increases with glass content as a function of temperature. High fouling potential, for example, was exhibited in pellets having a 22% glass content of total weight at 1840° F. Addition of the pressure-hydrated additive at 20% of the pellet weight, however, appears to reduce the potential fouling levels to low potential fouling at all temperatures (crushing strengths were reduced to near zero). It should be noted that the low fouling potential of the fly ash samples used in FIG. 3 result from the use of a higher grade, lower fouling coal than the coals used in FIGS. 1 and 2.

To control slagging or heavy deposits in a boiler, therefore, pressure-hydrated dolomitic lime is intermittently added either into the furnace or into the low pressure/temperature gas passages where slag deposits are known to form. The additives are added directly to the slag formations in concentrations that would approximate 20% of the total deposit weight at the situs where it is to be directed. Injection of the additives can be through the soot blowers located adjacent deposition areas. Alternately, the additive can be introduced directly into the furnace along with the fuel. The additive and the fuel, however, must be separated as combusting the mixture has been found to increase slag formation. These formations result from both exposing the additive to temperatures that are too high to enable the additives to effectively treat the combustion by-products, and the bonding of the additive with the fuel rather than with combustion by-products. Once the deposits have been treated they are removed by conventional soot blowing. In cases of severe slagging, weakened deposits can be removed by directly air lancing or steam spraying the deposits. This process, however, is relatively time consuming and applies to unusually severe deposits.

Intermittent introduction of the additives has beneficial effects on other boiler-related problems. Coating fly ash deposits, as shown, will reduce the crushing strengths of the deposits and also increase the sintering temperatures. As a result, fly ash catalyzation of sulfur dioxide into sulfur trioxide in the gas passages or other internal sections of the boiler will also be reduced. Reduction of sulfur trioxide formation, in turn, reduces corrosion. The previously described corrosion causing complex sulphates will be reduced or eliminated without the presence sulfur trioxide. Finally, intermittently coating boiler deposits will reduce acid smut emissions and plume visibility. The addition of alkali metals into combustion systems has been generally found to reduce acid smut and reduce visibility of the plume. Acid formation, such as sulfuric acid, is a direct by-product of the reaction between fouling deposits and sulfur dioxide gas. The reduction or elimination of deposits, therefore, will reduce or eliminate acidic smut. Finally, the visible plume will be greatly reduced because of reduced acid formation.

Although the invention has been described with respect to particular means, materials and embodiments, it is to be understood that the invention is not limited to the particulars disclosed and extends to encompass all equivalent embodiments falling within the scope of the claims.

What is claimed is:

1. In a process for treating a combustion system wherein pressure-hydrated dolomitic lime additives are added to the system, the improvement comprising removing fly ash deposits by locally injecting said pressure-hydrated dolomitic lime additives to the situs of said fly ash deposits, at a temperature above approximately 1800° F., in an amount and concentration sufficient to cause a weakened point in the deposits when they are formed, and so that at least 5% of the total deposit weight is comprised of said pressure-hydrated dolomitic lime additives thereby facilitating subsequent removal of said deposits; operating said system to permit deposition of fly ash to occur; and subsequently removing said fly ash deposits by breaking off said deposits at their weakened points.

2. The process as defined by claim 1 wherein said combustion system is a fuel-fired boiler.

3. The process as defined by claim 2 wherein said combustion system is oil-fired.

4. The process as defined by claim 2 wherein said combustion system is coal-fired.

5. The process as defined by claim 2 wherein said combustion system combusts refuse-derived fuel.

6. The process as defined by claim 2 comprising blowing said pressure-hydrated dolomitic lime additive into the interior of said boiler with soot blowers.

7. The process as defined by claim 6 comprising injecting said pressure-hydrated dolomitic lime additive only into the gas passages of said boiler and not directly into the furnace.

8. The process as defined by claim 7 further comprising applying said additive to fly ash deposits in said gas passages, and removing said fly ash deposits to which said additive has been applied by blowing them away with said soot blowers in order to reduce fouling deposits and corrosion in said gas passages.

9. The process as defined by claim 8 comprising injecting said pressure-hydrated dolomitic lime additive into said boiler with mechanical sprayer means.

10. The process as defined by claim 9 wherein said mechanical sprayer means is connected to said soot blowers for injecting said additive into said soot blowers.

11. The process as defined by claim 10 comprising operating said mechanical sprayer means and said soot blowers to automatically inject said additive intermittently.

12. The process as defined by claim 1 wherein said pressure-hydrated dolomitic lime additive comprises a powder of finely porous particles having a high specific surface and a low settling rate in water.

13. The process as defined by claim 12 wherein substantially 100% of said pressure-hydrated dolomitic lime additive particles pass through 20 Tyler mesh screen and 79% pass through 325 mesh screen.

14. The process as defined by claim 13 wherein said pressure-hydrated dolomitic lime is formed into a slurry having a solids content between about 10–50% by weight pressure-hydrated dolomitic lime particles.

15. The process as defined by claim 1 comprising injecting a blowing medium into the interior portions of said combustion system to loosen and remove deposits in said system prior to injecting said pressure-hydrated dolomitic lime additive in order that said additive will coat the most strongly bonded deposit areas.

16. The process as defined by claim 1 further comprising injecting said pressure-hydrated dolomitic lime additive directly into the furnace of said combustion system.

17. The process as defined by claim 17 further comprising separating said pressure-hydrated dolomitic lime additive from a system fuel during injection in order to avoid bonding between said additive and said fuel.

18. A process of reducing the extent of permanent fly ash deposition within a combustion system comprising injecting a slurry of pressure-hydrated dolomitic lime additive particles directly to the situs of fly ash deposits at a temperature above approximately 1800° F. in a concentration and frequency sufficient to raise the melting point of said fly ash deposits thereby minimizing the formation of the fly ash liquid phase at the situs of injection whereby a weakened point is formed, and so that at least 5% of the total deposit weight is comprised of said pressure-hydrated dolomitic lime additives and subsequently removing subsequent fly ash deposits by breaking said deposits at said weakened point, and blowing said deposits out of said combustion system at said weakened points.

19. A process of facilitating removal of slag deposits on an interior surface of a combustion system comprising the step of selectively and locally injecting a slurry of pressure-hydrated dolomitic lime additive particles directly to the situs of slag deposition at a temperature above approximately 1800° F. in a concentration and quantity sufficient to substantially coat such slag deposits, and so that at least 5% of the total deposit weight is comprised of said pressure-hydrated dolomitic lime additives, thereby: narrowing the temperature range in which the slag is plastic, reducing slag crushing strength of said deposits, and substantially eliminating bonding between said deposits and said interior surface of said combustion system, whereby said slag depositions may be removed from the coated interior surface of said combustion system.

* * * * *

UNITED STATES PATENT AND TRADEMARK OFFICE

CERTIFICATE OF CORRECTION

PATENT NO. : 4,616,574

DATED : October 14, 1986

INVENTOR(S) : Jack Z. ABRAMS et al.

It is certified that error appears in the above-identified patent and that said Letters Patent is hereby corrected as shown below:

Abstract, line 5, delete the "," after "porous".

Column 6, line 3, delete "of".

Column 8, line 12, delete "," after "blowers".

Column 8, line 17, "spary" should read ---spray---.

Column 8, line 51, "test" should read ---tests---.

Column 12, line 27, "claim 17" should read ---claim 16---.

Signed and Sealed this

Twenty-ninth Day of March, 1988

*Attest:*

DONALD J. QUIGG

*Attesting Officer*

*Commissioner of Patents and Trademarks*